US008764118B1

(12) United States Patent
Krishnamoorthy et al.

(10) Patent No.: US 8,764,118 B1
(45) Date of Patent: Jul. 1, 2014

(54) SENSOR MOUNTING SYSTEM FOR ROAD MILLING MACHINE

(71) Applicant: Caterpillar Paving Products Inc., Brooklyn Park, MN (US)

(72) Inventors: Sundararajan Krishnamoorthy, Chennai (IN); Arul Kumar Ramasamy, Mt. Zion, IL (US); Timothy Miller, Saint Paul, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 0 days.

(21) Appl. No.: 13/714,994

(22) Filed: Dec. 14, 2012

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)
USPC ..... 299/1.5; 299/39.6; 404/84.05

(58) Field of Classification Search
USPC ..... 299/1.5, 36.1, 39.1, 39.4, 39.6
See application file for complete search history.

(56) References Cited

U.S. PATENT DOCUMENTS 3,877,830 A * 4/1975 James, III ..... 404/84.1
3,989,402 A * 11/1976 James, III ..... 404/110
4,140,420 A 2/1979 Swisher, Jr. et al.
4,213,719 A 7/1980 Swisher, Jr. et al.
4,270,801 A 6/1981 Swisher, Jr. et al.
4,580,923 A * 4/1986 Brown ..... 404/84.1
5,378,081 A 1/1995 Swisher, Jr.
2008/0152428 A1 6/2008 Berning et al.
2009/0108663 A1 4/2009 Berning et al.
2012/0286558 A1* 11/2012 Berning et al. ..... 299/1.5
2012/0301220 A1* 11/2012 Snoeck et al. ..... 404/75

OTHER PUBLICATIONS

Wirtgen, Cold Milling Machine W 200/W 200i, report, Sep. 2012, 3 pages, Wirtgen Group, Germany.

* cited by examiner

*Primary Examiner* — David Bagnell
*Assistant Examiner* — Michael Goodwin
(74) *Attorney, Agent, or Firm* — Liell & McNeil

(57) ABSTRACT

A road milling machine includes a sensor mounting system having a first mounting member, which is attached to a first machine component and supports a portion of a position sensor, and a second mounting member attached to a second machine component having a pivotable attachment to a machine frame. An extension member has a first end attached to the second mounting member and a second end including an attachment flange. A unitary ski member has a first end attached to another portion of the position sensor and a second end pivotably attached to the attachment flange. The unitary ski member includes a ground engaging surface that is positioned inboard relative to first and second side plates, which flank a rotor, and has a pivot movement compensation curve. A controller is configured for determining a milling depth of the rotor from measurements obtained by the position sensor.

20 Claims, 5 Drawing Sheets

SENSOR MOUNTING SYSTEM FOR ROAD MILLING MACHINE

TECHNICAL FIELD

The present disclosure relates generally to a sensor mounting system for a road milling machine and, more particularly, to a sensor mounting system including an inboard ground engaging unitary ski member supporting a position sensor.

BACKGROUND

A road milling machine includes a plurality of ground engaging members supporting a machine frame of the road milling machine. The ground engaging members may include wheels or tracks, and may be connected to the machine frame through lifting columns. The lifting columns allow independent adjustment at each corner of the machine frame to facilitate various orientations of the machine frame relative to a ground surface to be treated, such as, for example, a paved surface. A rotor is supported by the machine frame and oriented perpendicularly relative to a longitudinal centerline of the road milling machine for treating or, for example, milling the paved surface. Typically, height adjustable side plates are positioned at opposite side ends of the rotor and define outer walls of the road milling machine. The side plates rest on the paved surface being treated and, thus, are raised relative to the machine frame as the machine frame is lowered during the milling process.

Due to the close proximity of the side plates to the rotational axis of the rotor, position sensors are often positioned to measure vertical movement of the side plates relative to the machine frame, or one another, to arrive at a milling depth, and/or inclination, of the rotor. Although acceptable in most circumstances, the measurements obtained by these position sensors may be inaccurate in particular scenarios. For example, when milling an edge of the paved surface being treated, one of the side plates may rest on an unpaved surface, which may include grass, rocks, or soil, rather than the paved surface. As such, the calculated milling depth at the edge may be inaccurate and may necessitate measurements by hand during the milling operation.

Wirtgen GmbH, a company headquartered in Windhagen, Germany, offers hydraulic milling depth sensors that capture the level on the sides and in front of a milling drum, as shown in the Wirtgen publication page submitted herewith. In particular, the Wirtgen hydraulic milling depth sensors positioned inboard relative to side plates flanking the milling drum appear to be supported near the ground surface by a pair of pivotably connected linear arms. Although the inboard hydraulic milling depth sensors of Wirtgen may provide one solution to the edge surface treatment problem described above, there is a continuing need to provide highly accurate sensors and sensor mounting arrangements for calculating milling depth.

The present disclosure is directed to one or more of the problems or issues set forth above.

SUMMARY OF THE DISCLOSURE

In one aspect, a road milling machine includes a machine frame carried by a plurality of ground engaging members, and a rotor supported by the machine frame and oriented perpendicularly relative to a longitudinal centerline of the road milling machine for treating a ground surface. First and second side plates are arranged at opposite side ends of the rotor. The road milling machine also includes a sensor mounting system. The sensor mounting system includes a first mounting member, which is attached to a first machine component and supports a first portion of a position sensor, and a second mounting member attached to a second machine component having a pivotable attachment to the machine frame. An extension member has a first end attached to the second mounting member and a second end including an attachment flange. A unitary ski member has a first end attached to a second portion of the position sensor and a second end pivotably attached to the attachment flange. The unitary ski member includes a ground engaging surface that is positioned inboard relative to the first and second side plates and has a pivot movement compensation curve. A controller of the road milling machine is configured for determining a milling depth of the rotor from measurements obtained by the position sensor.

In another aspect, a sensor mounting system for a road milling machine includes a first mounting member configured for attachment to a first machine component of the road milling machine and configured to support a portion of a position sensor. A second mounting member is configured for attachment to a second machine component having a pivotable attachment to a machine frame. An extension member has a first end configured for attachment to the second mounting member such that the extension member extends perpendicularly relative to a longitudinal centerline of the road milling machine, and a second end configured for attachment to an attachment flange. A unitary ski member has a first end configured for attachment to another portion of the position sensor and a second end configured for pivotable attachment to the attachment flange. The unitary ski member includes a ground engaging surface that is positioned inboard relative to the first and second side plates and has a pivot movement compensation curve.

In another aspect, a method for measuring a milling depth of a road milling machine having the sensor mounting system described above includes moving the road milling machine, via a plurality of ground engaging members, in a forward travel direction along a ground surface. A rotor supported on a frame of the road milling machine is lowered to a predetermined milling depth to treat the ground surface. The ground surface to be treated is contacted with the ground engaging surface of the unitary ski member at a first position along the pivot movement compensation curve of the ground engaging surface. The first position is a predetermined distance from a first ski attachment location of the unitary ski member and the position sensing device. A first milling depth of the rotor is determined using a controller from measurements obtained by the position sensor responsive to contacting the ground surface at the first position. A second ski attachment location of the unitary ski member and the attachment flange is pivoted relative to the machine frame. The ground surface to be treated is contacted with the ground engaging surface of the unitary ski member at a second position along the pivot movement compensation curve. The second position is the same predetermined distance from the first ski attachment location. A second milling depth of the rotor is determined using a controller from measurements obtained by the position sensor responsive to contacting the ground surface at the second position.

DETAILED DESCRIPTION

Figure 1:
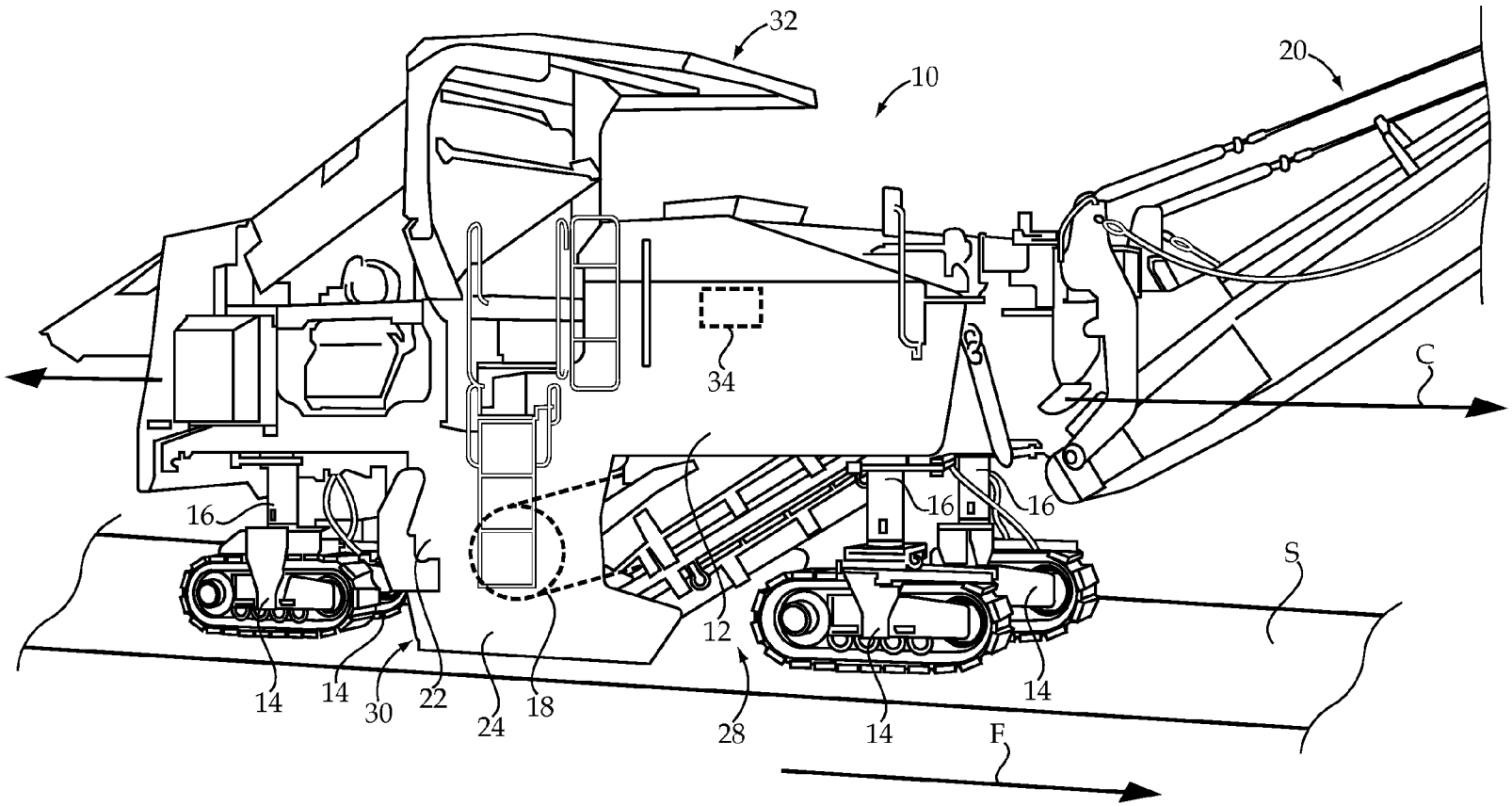
FIG. 1 is a perspective view of a road milling machine in which features of the present disclosure may be incorporated.

Referring now to FIG. 1, an exemplary road milling machine 10, referenced also as a cold planer, may generally include a machine frame 12 carried by a plurality of ground engaging members 14. The ground engaging members 14 may include wheels or tracks (as shown), and may be connected to the machine frame 12 through lifting columns 16. The lifting columns 16 allow independent adjustment at each corner of the machine frame 12 to facilitate various orientations of the machine frame 12 relative to a ground surface to be treated, such as, for example, a paved surface S. A rotor 18 is supported by the machine frame 12 and oriented perpendicularly relative to a longitudinal centerline C of the road milling machine 10 for treating or, for example, milling the paved surface S. The rotor 18 may be fitted with cutting tools and, as the road milling machine 10 moves in a forward travel direction F, the rotor 18 may be rotated, such as in a counterclockwise direction relative to the forward travel direction F, to remove material from the paved surface S. According to some embodiments, the removed material may be lifted using a conveyor system 20 to a dump truck (not shown) traveling in front of the road milling machine 10.

A chamber 22 houses the rotor 18 and includes a first height adjustable side plate 24 and a second height adjustable side plate 26 (not shown) positioned at opposite side ends of the rotor 18. The first and second side plates 24 and 26 define outer walls, which rest on the paved surface S being treated. As should be appreciated, the side plates 24 and 26 are raised relative to the machine frame 12 as the machine frame 12 is lowered during the milling operation. An anti-slab device 28 may be supported on a portion of the machine frame 12, such as the chamber 22, forward of the rotor 18 relative to the forward travel direction F. The anti-slab device 28 may press down on the paved surface S being treated to prevent large slabs from breaking out of the pavement layer. A scraper 30, also referenced as a moldboard, may be provided rearward of the rotor 18 relative to the forward travel direction F for smoothing the milled surface.

The machine frame 12 may also support an operator control station 32 having a variety of components and controls useful in operating the road milling machine 10. For example, the operator control station 32 may include devices for controlling engine operation, propulsion, steering, milling depth, rotor operation, and conveyor operation, to name a few. Although not shown, it should be appreciated that the road milling machine 10 may include an engine, such as an internal combustion engine, for powering the various systems and devices of the road milling machine 10, including the systems and devices described above. Further, the road milling machine 10 may include at least one controller 34, such as a programmed computer logic and associated memory, for translating input commands received from various input devices, or controllers, of the road milling machine 10 into command signals for controlling the appropriate system or device of the machine 10. According to some embodiments, the road milling machine 10 may include additional controls positioned at the sides of the machine 10 and/or near the ground engaging members 14 for more precisely controlling the milling operation while walking alongside the road milling machine 10.

Figure 2:
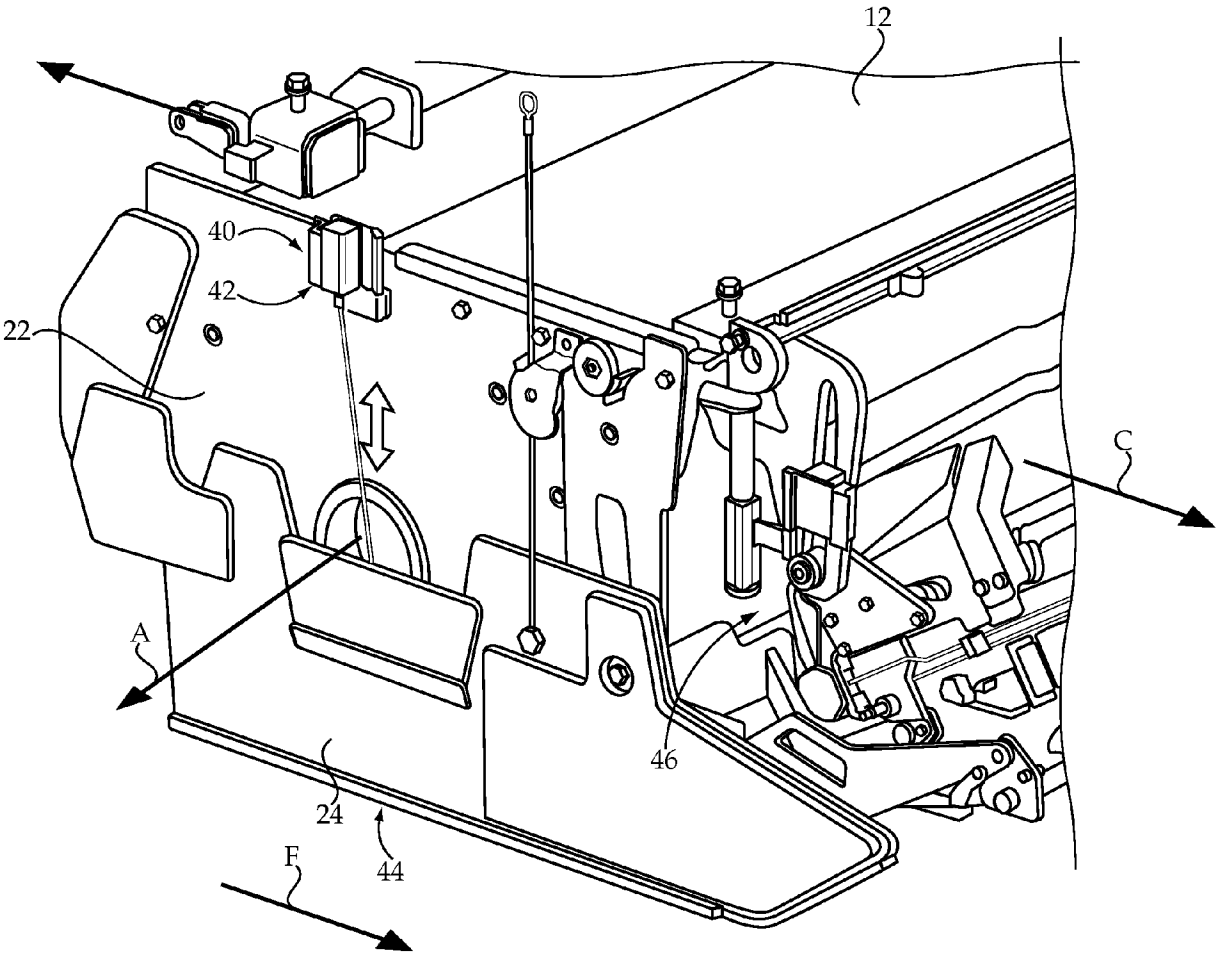
FIG. 2 is a perspective view of a chamber of the road milling machine, according to the present disclosure.

Turning now to FIG. 2, portions of the chamber 22 are shown with several components of the road milling machine 10 removed. According to some embodiments, each of the first and second side plates 24 and 26 may include an outboard position sensing device 40 positioned outboard relative to the first and second side plates 24 and 26. Although only the first side plate 24 is shown, it should be appreciated that the second side plate 26 may represent a mirror image of the first side plate 24 and may also include a position sensing device similar to the depicted outboard position sensing device 40. The outboard position sensing device 40 may include a wire rope sensor 42, or an alternative position sensing device, positioned and configured to measure the vertical displacement of a ground engaging portion 44 of the first side plate 24 with respect to the chamber 22. The displacement, which is measured near a rotational axis A of the rotor 18 (not shown in FIG. 2), may be used to calculate the current milling depth, as is known in the art. According to some embodiments, the vertical displacements of the first and second side plates 24 and 26 may be measured with respect to each other to determine an inclination of the chamber 22 with respect to the paved surface S to be treated.

Figure 3:
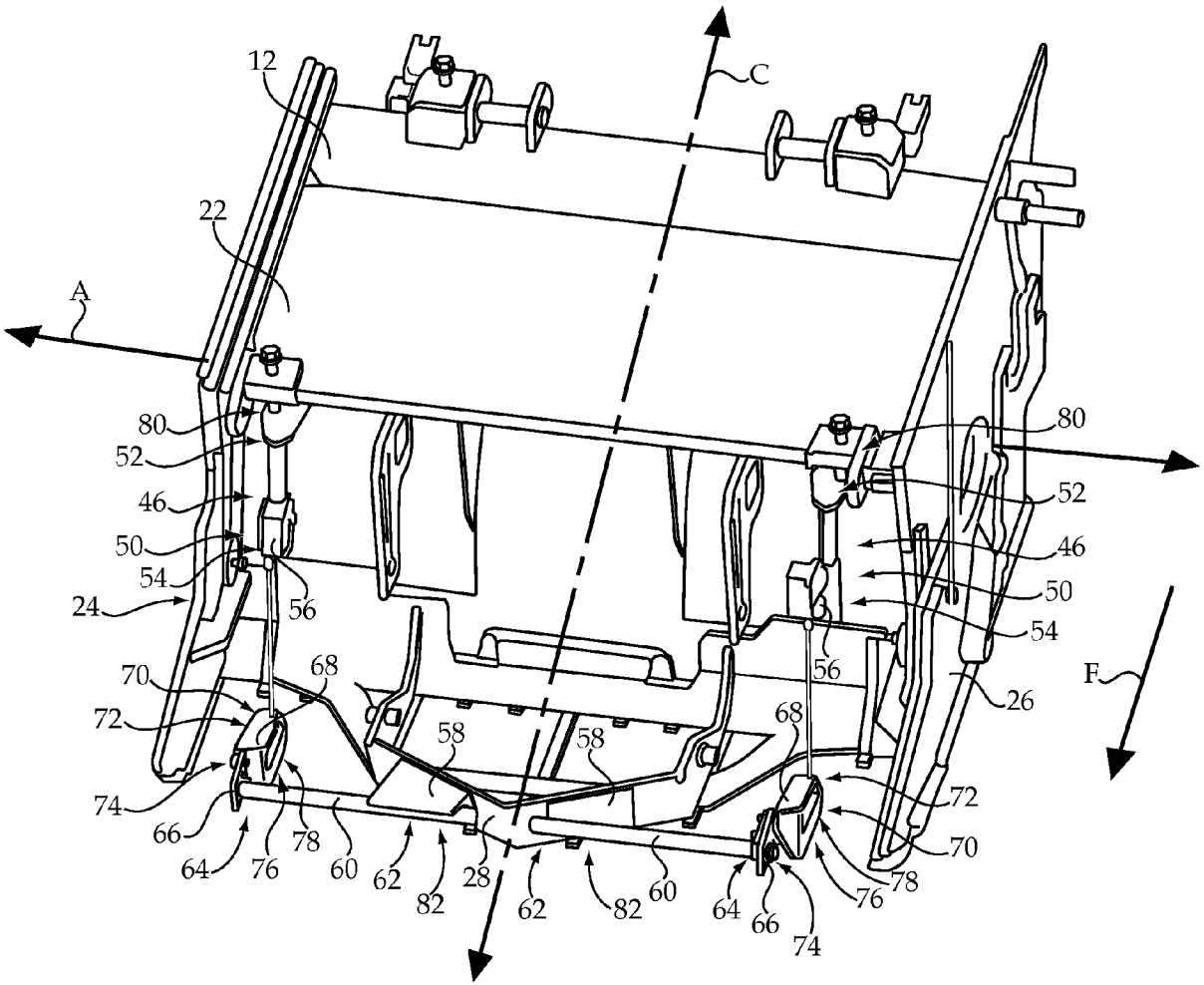
FIG. 3 is a different perspective view of the chamber of FIG. 2, showing an exemplary embodiment of a sensor mounting system according to the present disclosure.

In addition to, or as an alternative to, the one or more outboard position sensing devices 40, the road milling machine 10 may include one or more inboard position sensing devices 46, positioned inwardly relative to the first and second side plates 24 and 26. Turning now to FIG. 3, the inboard position sensing devices 46 may each include a sensor mounting system 50. Each of the sensor mounting systems 50 may generally include a first mounting member 52 attached to a machine component, such as, for example, the chamber 22 and supporting a first portion 54 of a wire rope sensor 56, or other position sensor. A second mounting member 58 may be attached to the anti-slab device 28, or another machine component having a pivotable attachment to the machine frame 12 and/or chamber 22. An extension member 60 may have a first end 62 attached to the second mounting member 58 and a second end 64 including an attachment flange 66. Each sensor mounting system 50 may also include a unitary ski member 68 having a first end 70 attached to a second portion 72 of the wire rope sensor 56 and a second end 74 pivotably attached to the attachment flange 66. As will be described in greater detail below, a ground engaging surface 76 of the unitary ski member 68 may include a pivot movement compensation curve 78.

The first mounting member 52 may be attached to the chamber 22, or other machine component, at a first mounting location 80 and the second mounting member 58 may be attached to the anti-slab device 28 at a second mounting location 82 that is forward of the first mounting location 80 relative to the forward travel direction F of the road milling machine 10. In addition, the second mounting location 82 may be inwardly spaced from the first mounting location 80 relative to the longitudinal centerline C. Thus, the extension member 60 may extend perpendicularly relative to the longitudinal centerline C of the road milling machine 10 to properly align the components, namely the first mounting member 52 and the unitary ski member 68, supporting the first and second portions 54 and 72 of the wire rope sensor 56.

As shown, the road milling machine 10 may include two inboard position sensing devices 46, which may be mirror images of one another, laterally spaced relative to the longitudinal centerline C and positioned inboard relative to the first and second side plates 24 and 26. As such, the first and second inboard position sensing devices 46 may be configured to measure the displacement of ground engaging surfaces 76 of the unitary ski members 68 with respect to the chamber 22 and/or with respect to each other to determine current milling depth and/or inclination of the chamber 22. In particular, the controller 34 may be configured to determine the milling depth of the rotor 18 from measurements obtained by the wire rope sensors 56, or other known position sensors.

Figure 4:
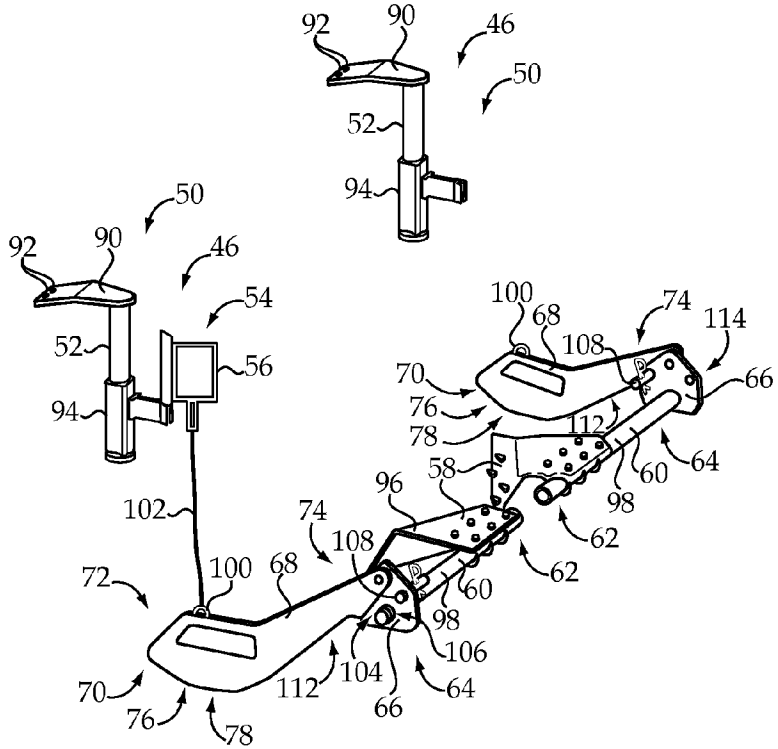
FIG. 4 is a perspective view of components of the exemplary sensor mounting system of FIG. 3, according to the present disclosure.

Turning now to FIG. 4, the components of the inboard position sensing devices 46 are shown removed from the road milling machine 10. As shown, the first mounting member 52 may be configured as a plate or bracket 90 structured and arranged for coupling to the chamber 22, or other portion of the machine frame 12. For example, the plate 90 may have an angled surface complementary to the angled surface of the chamber 22. Openings 92 in the plate may be aligned with openings in the chamber 22 such that fasteners (not shown) may be received through the openings 92 to mount the plate 90 to the frame 12. However, alternative mounting arrangements, in addition to bolted connections, are also contemplated. The first mounting member 52 may also include an adjustable sensor mount 94 for attaching the first portion 54, or base, of the wire rope sensor 56. The adjustable sensor mount 94 may permit vertical movement and rotational movement of the wire rope sensor 56 prior to fixing a desired position.

The second mounting member 58 may similarly be configured as a plate 96 structured and arranged for coupling to the anti-slab device 28. For example, the plate 96 may have an angled surface complementary to the angled surface of the anti-slab device 28. The plate 96 may have a bolted connection to the anti-slab device 28 or may be connected in a variety of other known ways. The extension member 60 may be configured as a tube 98 with the first end 62 coupled, such as via U-bolts, with the second mounting member 58 and the second end 64 defining the substantially planar attachment flange 66 arranged perpendicularly to the longitudinal direction of the extension member 60. The longitudinal dimension of the extension member 60 extends substantially laterally relative to the road milling machine 10, for example, substantially perpendicular to the forward travel direction F, as shown in FIG. 3.

The unitary ski member 68 is pivotably coupled with the attachment flange 66 such that the unitary ski member 68 extends behind the extension member 60 relative to the forward travel direction F of the machine 10. According to a specific example, the unitary ski member 68 may include an opening therethrough for receiving a sleeve-bearing. The unitary ski member 68 may rotate about the sleeve-bearing, with a bolt, washer, and nut holding the sleeve-bearing tightly against the attachment flange 66. Clearances may be provided on either side of the unitary ski member 68 at the joint and/or between the unitary ski member 68 and the sleeve-bearing to improve rotation of the unitary ski member 68. Thus, according to some embodiments, the unitary ski member 68 may be removably coupled with the attachment flange 66 so that the unitary ski member 68 can be replaced after a predetermined amount of wear.

According to the exemplary embodiment, the first end 70 of the unitary ski member 68 may include a hook 100 for receiving a wire 102 of the wire rope sensor 56. Additional and/or alternative features may also be provided. For example, the tube 98 may include an extended portion 104 extending through an opening 106 through the attachment flange 66. The extended portion 104 may be configured to restrict pivotable movement of the unitary ski member 68 to reduce potential damage of the wire rope sensor 56. For example, a bottom surface 112 of the unitary ski member 68 may contact the extended portion 104, which may prevent rotation of the unitary ski member 68 beyond a predetermined lengthening of the wire 102. According to an additional feature, a locking pin 108 may be positioned through openings in the unitary ski member 68 and attachment flange 66 to secure a raised position (shown at 114) of the unitary ski member 68, which may be useful when the inboard position sensing device 46 is not in use. An additional opening through the attachment flange 66 may be provided to receive and store the locking pin 108 when the inboard position sensing device 46 is in use and/or a raised position is not desired.

Figure 5:
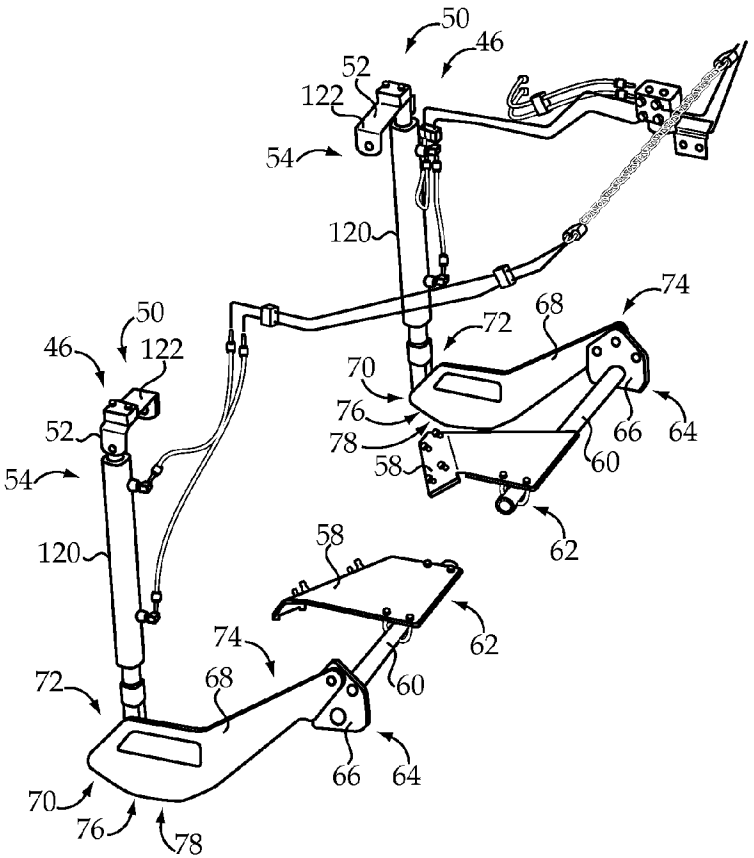
FIG. 5 is another exemplary embodiment of a sensor mounting system which may be incorporated onto the road milling machine of FIG. 1, according to the present disclosure.

According to an alternative embodiment, and as shown in FIG. 5, the inboard position sensing devices 46 may include position sensing cylinders 120. The sensor mounting systems 50 of the embodiment of FIG. 5 are similar to those shown in FIG. 4 and, as such, corresponding or similar reference numbers are used to refer to the same or corresponding parts. Differences between the embodiments of FIG. 4 and FIG. 5 include alternative first mounting members 52 and alternative attachment means incorporated with the unitary ski members 68. For example, the first mounting members 52 may include alternative plates 122 configured for engagement with the machine frame 12 and also configured for pivotable attachment of the position sensing cylinders 120. The unitary ski members 68 may similarly be adapted for pivotable attachment with the position sensing cylinders 120. Features present with the embodiment of FIG. 4 may be unnecessary for the embodiment of FIG. 5. For example, a raised position of the unitary ski members 68 may be facilitated by refraction of the position sensing cylinders 120 and, thus, the locking pin 108 of the embodiment of FIG. 4 may be unnecessary.

INDUSTRIAL APPLICABILITY

Figure 6:
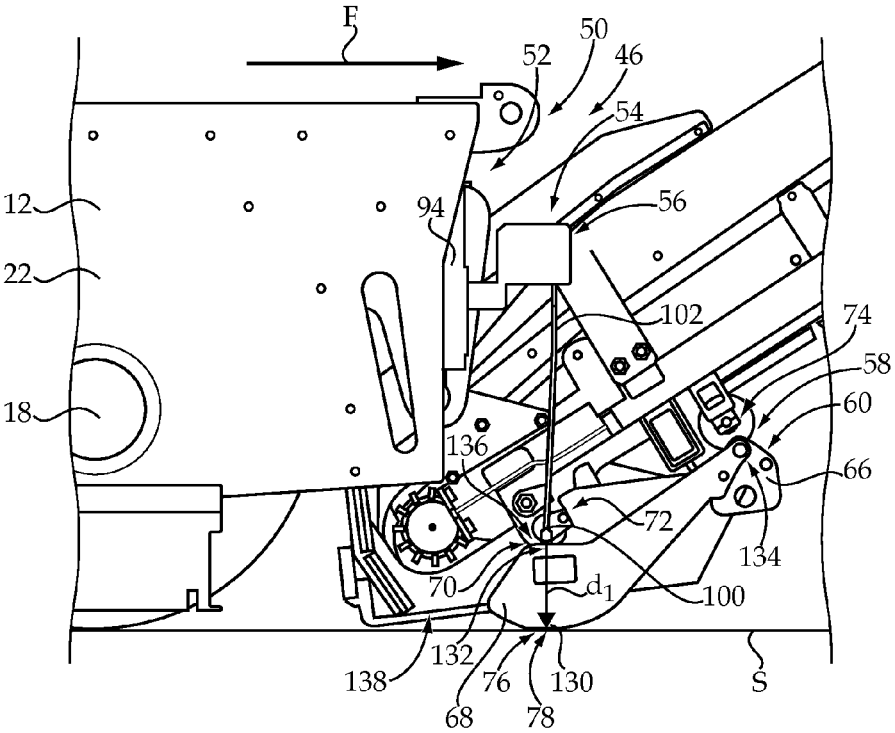
FIG. 6 is a perspective view of components of an exemplary sensor mounting system, shown at a first orientation, according to the present disclosure.

The road milling machine 10 equipped with the inboard position sensing devices 46 described herein may be operated in the following manner in order to measure the current milling depth of the machine 10. With reference to FIG. 1, the road milling machine 10 may be moved, via the plurality of ground engaging members 14, in a forward travel direction F along the paved surface S. The rotor 18, supported on the machine frame 12, may be lowered to a predetermined milling depth to treat the paved surface S. According to the exemplary embodiments of FIGS. 3 and 4, and with reference now to FIG. 6, the paved surface S to be treated may be contacted with the ground engaging surface 76 of the unitary ski member 68 at a first position 130 along the pivot movement compensation curve 78. The first position 130 is a predetermined distance $d_1$ from a first ski attachment location 132, which is the location at which the unitary ski member 68 is attached to the wire 102. A first milling depth may then be determined via the controller 34 using measurements obtained by the wire rope sensor 56.

The unitary ski member 68 is attached to the second mounting member 58 via the extension member 60 and attachment flange 66 at a second ski attachment location 134. As described above, the second mounting member 58 may be attached to the anti-slab device 28, which is pivotable relative to the machine frame 12. For example, the anti-slab device 28 may pivot about a pivot axis 136 as the anti-slab device 28 encounters unevenness of the paved surface S. In addition, the orientation of the anti-slab device 28 about the pivot axis 136 may change as a bottom surface 138 of the anti-slab device 28 wears. The pivot movement compensation curve 78, which corresponds to the ground engaging surface 76 of the unitary ski member 68, represents a curvature of the ground engaging surface 76 that compensates for the movement of the anti-slab device 28 about the pivot axis 136.

Figure 7:
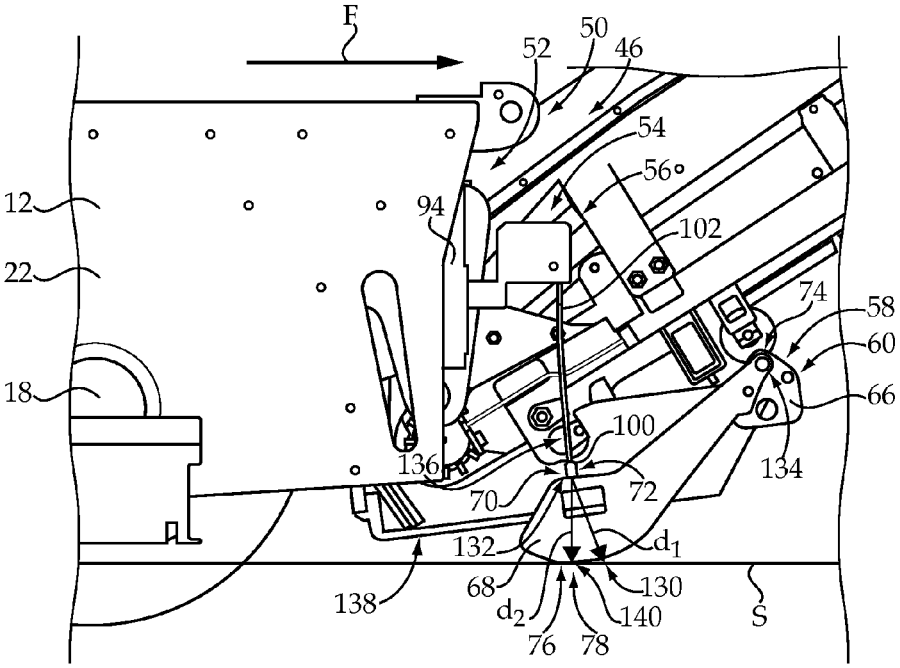
FIG. 7 is a perspective view of components of the exemplary sensor mounting system of FIG. 6, shown at a second orientation, according to the present disclosure.

In particular, as the anti-slab device 28 pivots about the pivot axis 136, the second ski attachment location 134 will be shifted along a vertical axis. For example, during the milling operation, the second ski attachment location 134 may be raised relative to the machine frame 12 as a result of the pivotable movement of the anti-slab device 28 in a first direction. As shown in FIG. 7, and as a result of the vertical movement of the second ski attachment location 134, the paved surface S may be contacted with the ground engaging surface 76 of the unitary ski member 68 at a second position 140 along the pivot movement compensation curve 78. The second position 140 is spaced from the first position 130 along the pivot movement compensation curve 78 and has a distance $d_2$ from the first ski attachment location 132 that is the same as, or substantially similar to, the distance $d_1$ between the first position 130 and the first ski attachment location 132. A second milling depth may then be determined via the controller 34 using measurements obtained by the wire rope sensor 56.

If the anti-slab device 28 is pivoted in a second direction that is opposite the first direction, the second ski attachment location 134 may be lowered relative to the machine frame 12. As the second ski attachment location 134 is lowered, the unitary ski member 68 will be pivoted such that the paved surface S is contacted with the ground engaging surface 76 of the unitary ski member 68 at a third position (not shown) along the pivot movement compensation curve 78. As should be appreciated, the third position may be spaced from the first position 130 along the pivot movement compensation curve 78 in a direction opposite the spacing of the second position 140 from the first position 130. The third position may also have a distance (not shown) from the first ski attachment location 132 that is the same, or substantially similar to, the distances $d_1$ and $d_2$ between the first and second positions 130 and 140 and the first ski attachment location 132.

The first and second milling depths may have improved accuracy based on the inboard position sensing devices 46 described herein and based, more particularly, on the sensor mounting systems 50 disclosed herein. In particular, the pivot movement compensation curve 78 may be configured such that each ground engaging location along the pivot movement compensation curve 78 is the same distance from the first ski attachment location 132. The pivot movement compensation curve 78 may also span the entire ground engaging surface 76 of the unitary ski member 68, which may include all potential ground engaging locations that may result from the pivotable movement range of the anti-slab device 28 and resulting vertical movement of the second ski attachment location 134.

One or both of the inboard position sensing devices 46 may be used in combination with or as alternatives to outboard position sensing devices 40. For example, one or both of the inboard position sensing devices 46 may be particularly useful when milling an edge of the paved surface S. Locating the inboard position sensing devices 46 inboard relative to the side plates 24 and 26 avoids the inaccuracies that may result from utilizing the outboard position sensing devices 40 supported on the side plates 24 and 26. As described above, when milling an edge of the paved surface S, one of the side plates 24 and 26 may rest on an unpaved surface, which may include grass, rocks, or soils, rather than the paved surface S, and may result in inaccurate milling depth measurements.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A road milling machine, comprising:

a machine frame carried by a plurality of ground engaging members;

a rotor supported by the machine frame and oriented perpendicularly relative to a longitudinal centerline of the road milling machine for treating a ground surface;

first and second side plates arranged at opposite side ends of the rotor;

a sensor mounting system including:

a first mounting member attached to a first machine component and supporting a first portion of a first position sensor;

a second mounting member attached to a second machine component having a pivotable attachment to the machine frame;

an extension member having a first end attached to the second mounting member and a second end including an attachment flange; and a unitary ski member having a first end attached to a second portion of the first position sensor and a second end pivotably attached to the attachment flange, wherein the unitary ski member includes a ground engaging surface that is positioned inboard relative to the first and second side plates, and the ground engaging surface has a pivot movement compensation curve; and a controller configured for determining a milling depth of the rotor from measurements obtained by the first position sensor.

2. The road milling machine of claim 1, wherein the first mounting member is attached to the first machine component at a first mounting location and the second mounting member is attached to the second machine component at a second mounting location that is forward of the first mounting location relative to a forward travel direction of the road milling machine, wherein the second mounting location is inwardly spaced from the first mounting location relative to the longitudinal centerline, and wherein the extension member extends perpendicularly relative to the longitudinal centerline.

3. The road milling machine of claim 2, wherein the second machine component is an anti-slab device; and the anti-slab device is positioned forward of the rotor relative to the forward travel direction.

4. The road milling machine of claim 2, wherein the first position sensor is a wire rope sensor.

5. The road milling machine of claim 4, further including a locking pin positioned through the attachment flange and configured to maintain a raised position of the unitary ski member.

6. The road milling machine of claim 4, wherein the second end of the extension member includes an elongate tube extending through an opening through the attachment flange, and wherein an extended portion of the elongate tube is configured to restrict pivotable movement of the unitary ski member.

7. The road milling machine of claim 2, wherein the first position sensor is a position sensing cylinder.

8. The road milling machine of claim 1, further including a second position sensor laterally spaced from the first position sensor relative to the longitudinal centerline and positioned inboard relative to the first and second side plates.

9. The road milling machine of claim 1, further including a second position sensor positioned outboard relative to the first and second side plates.

10. A sensor mounting system for a road milling machine, comprising:

a first mounting member configured for attachment to a first machine component of the road milling machine and configured to support a first portion of a first position sensor;

a second mounting member configured for attachment to a second machine component having a pivotable attachment to a machine frame of the road milling machine, an extension member having a first end configured for attachment to the second mounting member such that the extension member extends perpendicularly relative to a longitudinal centerline of the road milling machine, and a second end configured for attachment to an attachment flange; and a unitary ski member having a first end configured for attachment to a second portion of the first position sensor and a second end configured for pivotable attachment to the attachment flange, wherein the unitary ski member includes a ground engaging surface that is positioned inboard relative to first and second side plates that flank a rotor of the road milling machine, and the ground engaging surface has a pivot movement compensation curve.

11. The sensor mounting system of claim 10, wherein the first position sensor is a wire rope sensor.

12. The sensor mounting system of claim 11, wherein the unitary ski member includes a hook for receiving a wire of the wire rope sensor.

13. The sensor mounting system of claim 12, further including a locking pin positioned through the attachment flange and configured to maintain a raised position of the unitary ski member.

14. The sensor mounting system of claim 12, wherein the second end of the extension member includes an elongate tube extending through an opening through the attachment flange, and wherein an extended portion of the elongate tube is configured to restrict pivotable movement of the unitary ski member.

15. The sensor mounting system of claim 10, wherein the first position sensor is a position sensing cylinder.

16. A method for measuring a milling depth of a road milling machine having a sensor mounting system, the sensor mounting system including: a first mounting member attached to a first machine component of the road milling machine and supporting a first portion of a first position sensor; a second mounting member attached to a second machine component having a pivotable attachment to a machine frame; an extension member having a first end attached to the second mounting member and a second end including an attachment flange; and a unitary ski member having a first end attached to a second portion of the first position sensor at a first ski attachment location and a second end pivotably attached to the attachment flange at a second ski attachment location, wherein the unitary ski member includes a ground engaging surface positioned inboard relative to first and second side plates that flank a rotor of the road milling machine, the method comprising steps of:

moving the road milling machine, via a plurality of ground engaging members, in a forward travel direction along a ground surface;

lowering the rotor supported on the machine frame to a predetermined milling depth to treat the ground surface;

contacting the ground surface to be treated with the ground engaging surface of the unitary ski member at a first position along a pivot movement compensation curve of the ground engaging surface, wherein the first position is a predetermined distance from the first ski attachment location;

determining, via a controller, a first milling depth of the rotor from measurements obtained by the first position sensor responsive to contacting the ground surface at the first position;

pivoting the second ski attachment location relative to the machine frame;

contacting the ground surface to be treated with the ground engaging surface of the unitary ski member at a second position along the pivot movement compensation curve, wherein the second position is also the predetermined distance from the first ski attachment location; and determining, via the controller, a second milling depth of the rotor from measurements obtained by the first position sensor responsive to contacting the ground surface at the second position.

17. The method of claim 16, wherein the step of pivoting the second ski attachment location relative to the machine frame includes pivoting the second machine component relative to the machine frame.

18. The method of claim 17, wherein the step of pivoting the second machine component relative to the machine frame includes pivoting an anti-slab device relative to the machine frame, wherein the anti-slab device is positioned forward of the rotor relative to the forward travel direction.

19. The method of claim 16, further including determining the first milling depth and the second milling depth using a wire rope sensor.

20. The method of claim 16, further including determining the first milling depth and the second milling depth using a position sensing cylinder.

* * * * *

UNITED STATES PATENT AND TRADEMARK OFFICE

CERTIFICATE OF CORRECTION

PATENT NO. : 8,764,118 B1
APPLICATION NO. : 13/714994
DATED : July 1, 2014
INVENTOR(S) : Krishnamoorthy et al.

It is certified that error appears in the above-identified patent and that said Letters Patent is hereby corrected as shown below:

In the Claims

Column 9, lines 25-33, in Claim 10, delete "a unitary ski member having a first end configured for attachment to a
second portion of the first position sensor and a second end configured for pivotable attachment to the attachment flange, wherein the unitary ski member includes a ground engaging surface that is positioned inboard relative to first and second side plates that flank a rotor of the road milling machine, and the ground engaging surface has a pivot movement compensation curve." and
insert -- a unitary ski member having a first end configured for attachment to a second portion of the first position sensor and a second end configured for pivotable attachment to the attachment flange, wherein the unitary ski member includes a ground engaging surface that is positioned inboard relative to first and second side plates that flank a rotor of the road milling machine, and the ground engaging surface has a pivot movement compensation curve. --.

Signed and Sealed this
Fifteenth Day of September, 2015

Michelle K. Lee

Michelle K. Lee
*Director of the United States Patent and Trademark Office*